United States Patent [19]

Montijo

[11] Patent Number: 4,888,847

[45] Date of Patent: Dec. 26, 1989

[54] SCRUBBING PAIL DEVICE

[76] Inventor: Alicia K. Montijo, 1270 B Rabdolph Ave., Grand Forks, AFB, N. Dak. 58205

[21] Appl. No.: 183,725

[22] Filed: Apr. 20, 1988

[51] Int. Cl.[4] ..... A47J 13/142

[52] U.S. Cl. ..... 15/263; 15/264

[58] Field of Search ..... 15/1, 260, 263, 264; 68/4, 27, 181 R; 134/155, 186

[56] References Cited

U.S. PATENT DOCUMENTS 1,935,157 11/1933 Lisanti ..... 15/263

4,525,892 7/1985 Vayas et al. ..... 15/263

*Primary Examiner*—Harvey C. Hornsby

*Assistant Examiner*—Corinne M. Reinckens

*Attorney, Agent, or Firm*—Robert E. Kleve

[57] ABSTRACT

The invention comprises a scrubbing pail device having a pail with a fresh water reservoir detachably mounted to the pail. The reservoir has a recess for receiving a mop, with a rotatable receptacle therein to open and close valve means between the receptacle and the reservoir to allow fresh water from the reservoir to flow onto the mop for cleaning the mop with fresh water from time to time. The receptacle is also rotatable to open and close drain openings between the receptacle and the pail to allow the water in the receptacle to drain into the pail.

3 Claims, 3 Drawing Sheets

SCRUBBING PAIL DEVICE

This invention relates to scrubbing apparatus and the like.

It is an object of the invention to provide a novel scrubbing pail device having a replenishable fresh water reservoir mounted thereto.

It is a further object of the invention to provide a novel scrubbing pail device fresh water reservoir compartment detachably mounted to a pail and with the reservoir compartment having a main resceptacle area for receiving a mop with means to release water from the reservoir onto the mop and with means to drain water from the receptacle into the pail.

It is a further object of the invention to provide a novel scrubbing pail device having a fresh water reservioir compartment for releasing water onto a mop in a portion of the device and with draining mechanism to drain the water after its release onto the mop into a pail.

It is a further object of the invention to provide a novel fresh water reservior detachably mounted on a pail and with a receptacle or recess in the reservioir for receiving a mop and for releasing water onto the mop for washing the mop and which reservior can be detached from the pail.

Further objects and advantages of the invention will become apparent as the description proceeds and when taken in conjunction with the accompanying drawings wherein.

Briefly stated, the invention comprises a scrubbing pail device having a pail and a detachable fresh water reservoir compartment detachably mounted to the pail, said reservoir compartment having a recess for receiving a mop and a rotatable receptacle in the recess which may be rotated to open and close valve means in the compartment to release water from the compartment onto a mop in the recess for washing the mop and with drain means in the compartment to drain water from the recess into the pail.

Figure 1:
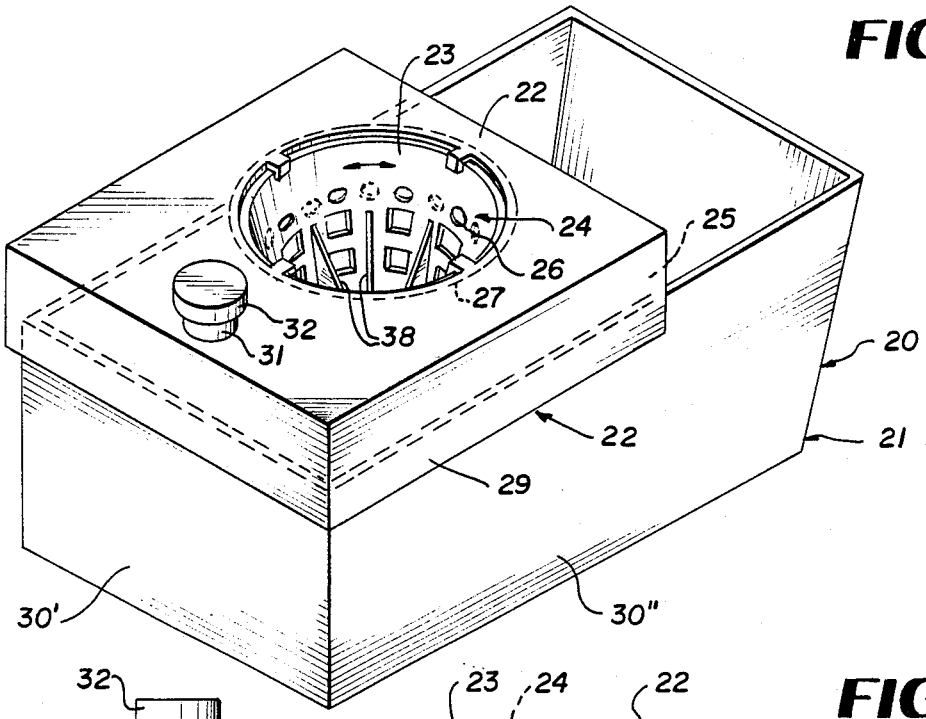
FIG. 1 is a perspective view of the scrubbing pail device illustrating the pail having a fresh water reservoir compartment detachably mounted to the pail and illustrating a receess in the compartment for receiving a mop.

Referring more particularly to the drawings, in FIG. 1 the scrubbing pail invention 20 is illustrated having a pail 21 with reservoir compartment 22 detachably mounted to the pail 21. The compartment 22 has a recess with a rotatable basket like receptacle 24 rotatably mounted in the recess of the compartment 22. The compartment 22 also has a reservoir area 25 which serves as a compartment for retaining fresh water therein in water tight relation. The receptacle 24 is circular and has openings 26 about its circumference. The reservoir 25 has a circular side wall 27 which surrounds the receptacle with openings 28 in the side wall 27 about its circumference which communicates with the openings 26 in the receptacle when the receptacle is rotated to align its openings with the reservoir openings, and with the receptacle 24 being rotatably mounted to the circular side wall 27 of the reservoir to move the openings 26 of the receptacle in and out of alignment with the openings in the reservoir.

The reservior compartment 22 has side flanges 29 which extend down from three sides of the compartment over the sides 30,30' and 30" of the pail for detachably supporting the compartment 22 on the pail. The reservoir 22 also has a spout 31 which communicates into the interior of the comparttherethrough, and a cap 32 is threadably attached to the spout 31 to selectively close the opening into the spout by its attachment thereto. The recess receptacle 24 has annular ridges 43 that are rotatably mounted in annular grooves 34' in the circular wall 27 of the reservoir for rotatably supporting the receptacle 24 in the wall. The circular wall 27 is in the center of of the reservoir 22 with the upper portion 27' fixed to the top wall 33 and the intermediate portion 27" fixed to the bottom wall 33', and with the bottom portion 27''' extending downward from the bottom wall 33'. The compartment 22 has four side walls 40,40',40", and 40''' fixed to one another to form 90 degree corners and to surround the wall 27. The side walls 40–40''', are formed integrally with the top and bottom walls 33 and 33' and with the circular wall 27 to form a watertight reservoir with the only openings being the spout and openings 26. Thge flanges 29 are fixed to the side walls 40, 40' and 40" in spaced relation. Four lugs 35 project from the top of the wall 27 over the top edge 36 of the receptacle 24 to maintain the receptacle 24 in the grooves of the wall 27 for its rotation.

Figure 4:
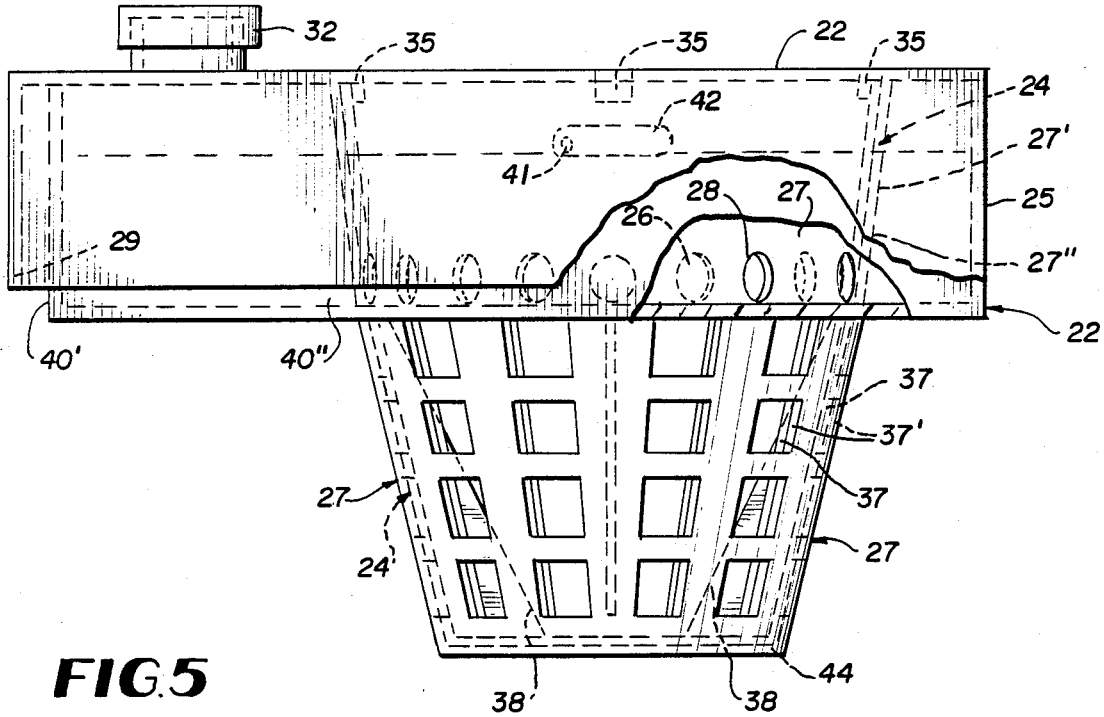
FIG. 4 is an enlarged side elevational view of the detachable fresh water compartment and illustrating the mop recess in the compartment with a fragmentary view of the pail.
Figure 5:
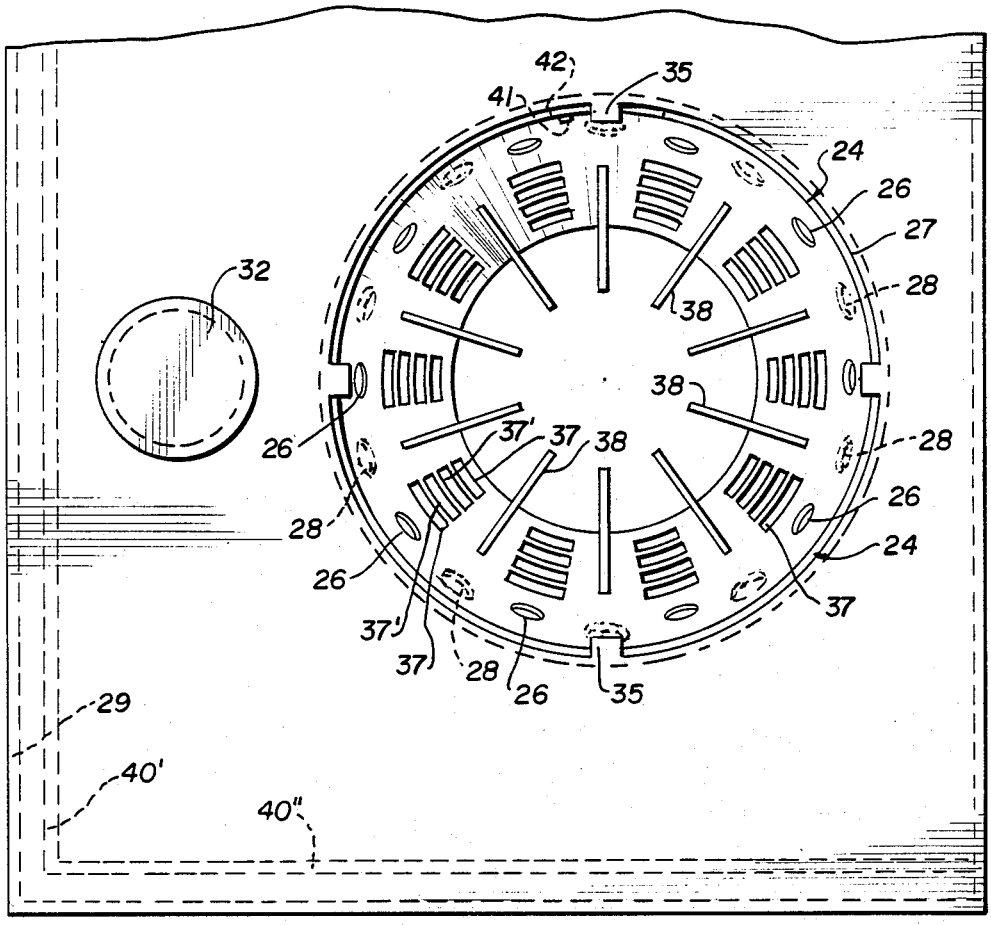
FIG. 5 is a fragmentary enlarged top plan view of the detachable fresh water compartment illustrating the recess for the mop.
Figure 6:
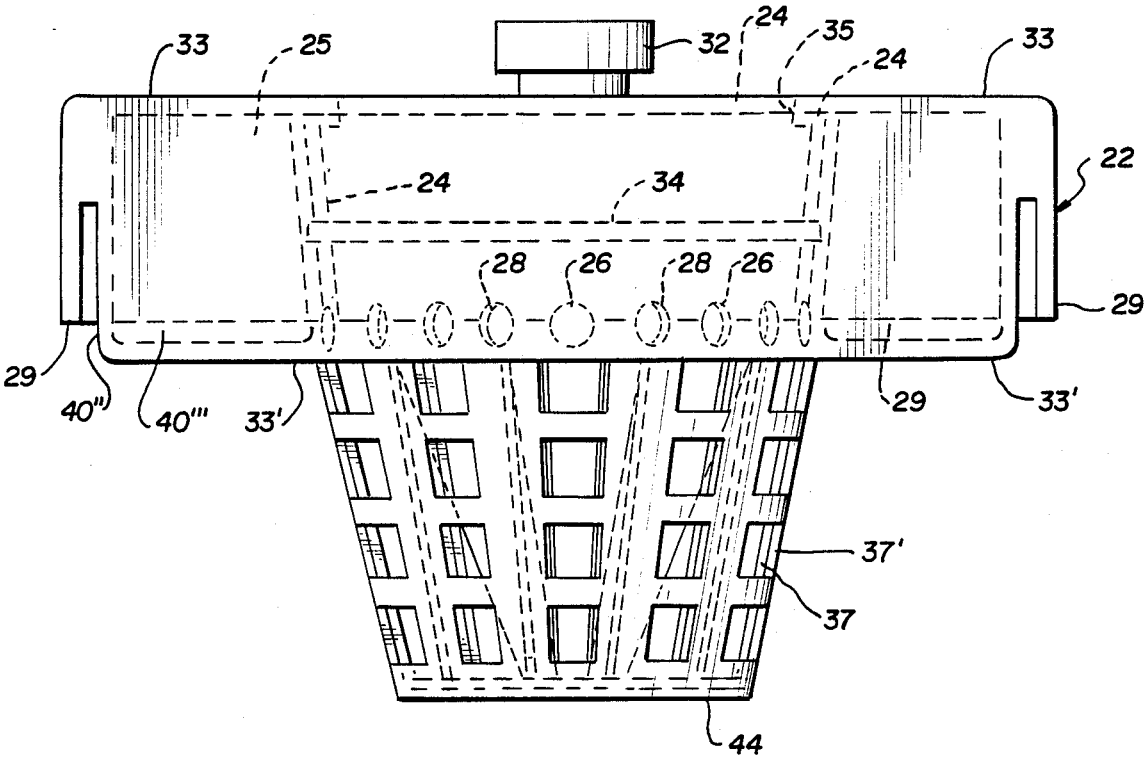
FIG. 6 is an enlarged front elevational view of the fresh water compartment.
Figure 7:
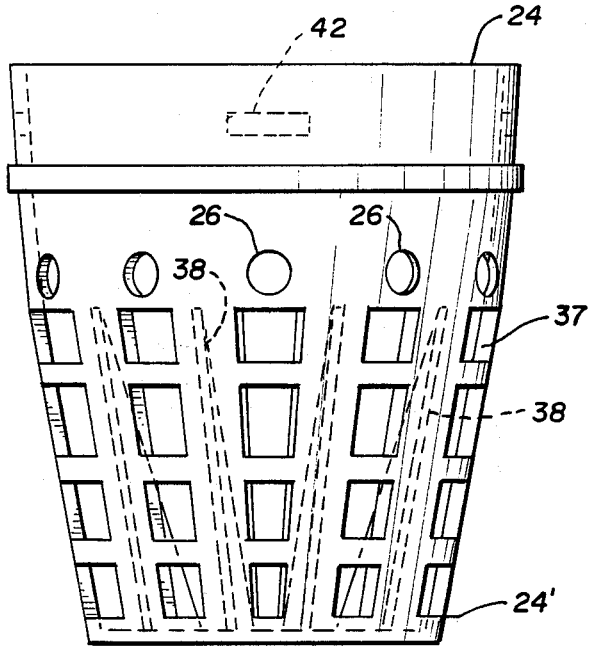
FIG. 7 is an enlarge front elevational view of the rotatable receptacle of the recessed portion of the compartment.

The circular reeceptacle 24 and the circular side wall 27 of the compartment or reservoir 22 also have drain openings 37 and 37' in their lower portions 24' and 27''' respectively which when in alignment with one another allow water to drain from the receptacle 24 out through the openings 37 of the receptacle and out the bottom openings 37' of the lower side wall portion 27''' of the side wall of the reservoir into the pail, when the compartment 22 is detachably mounted to the pail. FIGS. 4–6 inclusive illustrate the drain openings 37 of the receptacle 24 and the drain openings 37' of the lower wall portion 27''' in alignment with one another so that water may travel from the receptacle 24 through the lower circular side wall 27''' into the pail, while the openings 28 of the reservoir 22 and the openings 26 of the recessed rotatable receptacle 24 are out of alignment so that water cannot travel from the reservoir 22 into the receptacle. The rotation of the receptacle 24 approximately 18 degrees counterclockwise (FIG. 5) from shown will place the openings 26 and 28 into alignment so that water can travel out the reservoir 22 into the receptacle 24, while this rotation will move the openings 37 and 37' out of alignment with one another so that water cannot travel out from the receptacle 24 through the bottom portion 27''' of the wall 27 into the pail. Suitable rubber or resilient seals may be provided between the openings to prevent leakage.

OPERATION

Figure 2:
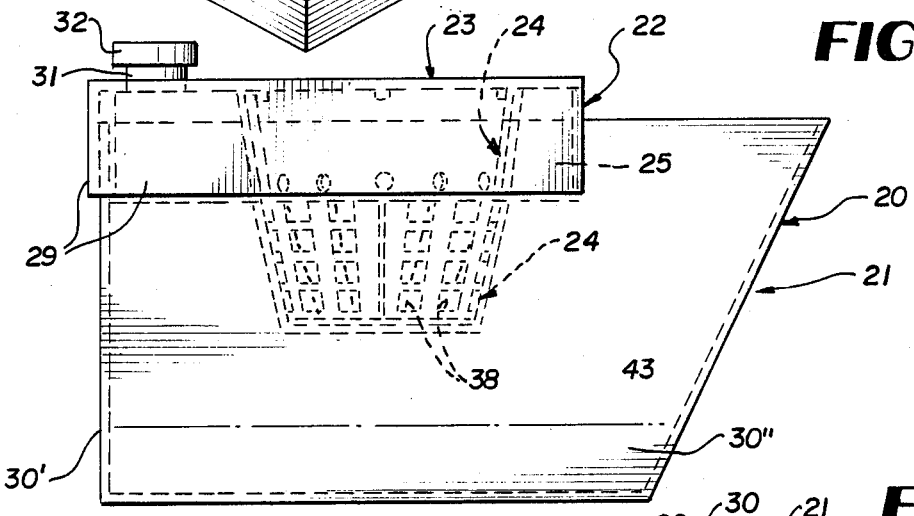
FIG. 2 is a side elevational view of the scrubbing pail device.
Figure 3:
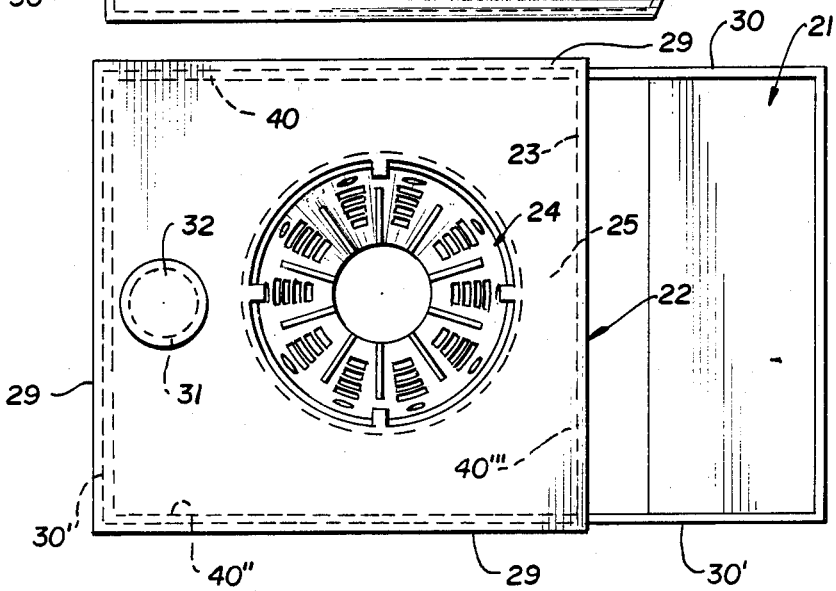
FIG. 3 is an top view of the scrubbing pail device.

The scrubbing pail invention 20 operates as follows: The operator will fill the pail 21 approximately ¼th full as indicated by the line 43, and then will also detach the reservoir 22 from the pail 21 and take it to a source of water and remove the cap 31 to fill the reservoir with clean water and then replace the cap and reattach the reservoir compartment 22 to the pail 21 as illustrated in FIGS. 1 and 2. The pail will be provided with a suitable handle means (not shown) so that the pail, with the reservoir 22 attached, can be moved to a floor area which the operator desires to mop. Upon moving the pail and reservoir to the mopping location, the operator will take the mop and wet it initially in the water in the pail and mop the floor until the mop becomes sufficiently dirty so that it needs to be cleaned. Whereupon, the operator may wash the mop in the pail again, however, if this water has become too dirty, will rather place the mop in the receptacle 24 of the reservoir 22. The operator will then rotate the receptacle 24 with respect to the reservoir apparatus 22 from its position illustrated in FIGS. 2–5 approximately 18 degrees clockwise which will place the openings 26 and 28 in alignment with one another and will place openings 37 and 37' out of alignment with one another so that water can flow from the compartment 22 into the receptacle 24. When sufficient water has flowed from the reservoir or compartment 22 into the receptacle 24 and onto the mop in the receptacle, the operator will rotate the receptacle 24 back to its position illustrated in FIGS. 2–5, which moves the openings 26 and 28 out of alignment with one another and stops the flow from the reservoir 22 into the receptacle, while it moves the openings 37 and 37' into alignment with one another which allows water in the receptacle 24 and mop to drain out of the receptacle and mop through the openings 37 and 37' into the pail.

The operator may push the mop against the receptacle 24 to cause the excess water to flow out of the mop and the water may travel out of the receptacle 24 and the wall 27''' of the compartment through the openings 26 and 28 of the receptacle and lower wall 27''' respectively and drain into the bottom of the pail 21. The release of the water from the reservoir 22 onto the mop in the receptacle and the action of the fresh water from the reservoir with the mop acts to cleanse the mop, as well as moisten it for further mopping. The operator will from time to time place the mop back into the receptacle 24 and release additional water onto the mop from the reservoir and force the water out of the mop in the same manner as before, thereby cleaning the mop from time to time with fresh water or clean water each time.

The vanes 38 are fixed in the receptacle 24 to enable the mop to be pushed against them to facilitate forcing water out of the mop. A slot 41 may be provided in the receptacle and a pin 42 fixed in the wall 27 to move in the slot to limit the movement of the receptacle with respect to the wall 27.

Thus it will be seen that a novel scrubbing apparatus has been provided that enables one to remoisten the mop from time to time as well as clean the mop each time with fresh water from the reservoir, when using the mop for mopping the floor by the use of the receptacle and reservoir attachment to the pail. Also, the receptacle and reservoir attachment may be detached from the pail by sliding the apparatus upward off the tops of the sides 30, 30', 30'' so that the reservoir may be taken to a source of fresh water from time to time and refilled with fresh water and then reattached to the pail. The pail may be made larger than illustrated in relation to the reservoir so that more than one or two fillings of the reservoir may be drained into the pail, before the level of the water in the pail reaches the bottom of the wall 27 of the reservoir. It is contemplated that the reservoir will hold approximately one gallon when filled. The wall 27 has a bottom 44 so that it completely encloses the bottom of the receptacle 24 in watertight relation except for the openings 37' in the bottom portion 27''' of the wall 27.

It is contemplated that the pail be sufficiently large with respect to the reservoir for at least one or two, preferably two, fillings of the reservoir may be drained into the pail, before the level of water rises from the ¼ level to the bottom 44 of the wall 27. The reservoir may be larger so that more than one gallon may be needed to fill the reservoir. It is further contemplated that the receptacle be at least a minimum of 6–7 inches in diameter so that the entire mop head of a conventional mop may be entirely received in the lower portion of the receptacle and be entirely beneath the openings 26 in the receptacle.

It will be obvious that various changes and departures may be made to the invention without departing from the spirit and scope thereof and accordingly, it is not intended that the invention be limited to that specifically described in the specification or as illustrated in the drawings but only as set forth in the appended claims wherein,

What is claimed is:

1. A scrubbing pail device comprising a pail, a fluid tight compartment detachably mounted to the top of the pail, a receptacle horizontally beside the compartment at the top of the pail and attached to the compartment for receiving a mop from the top of the receptacle, capped spout means in the top of the compartment serving as a closable opening for filling and replenishing fluid in said compartment with said compartment detachable from said pail for said replenishing of fluid in said compartment, said receptacle having its bottom below said compartment with passage means from the bottom of the compartment to said receptacle to provide a gravity flow of fluid from said compartment to said receptacle, valve means including a first valve means in said passage means to release fluid in said compartment through said passage means into said receptacle under a gravity flow for moistening a mop in said receptacle, said valve means including a second valve means in the bottom of said receptacle to release fluid from said receptacle into said pail.

2. A scrubbing pail device comprising a pail, a water tight compartment, flange means to detachably mount said compartment to the upper side edges of said pail, said compartment having a spout to introduce water into said compartment, a rotatable receptacle rotatably mounted in said compartment and forming a recess in said compartment, said receptacle being open at its top to receive a mop therein, means to rotate said receptacle relative to said compartment with valve means upon rotation acting to release water in said compartment into said receptacle for moistening said mop with water from said compartment, means to further rotate said receptacle to close said valve means to prevent water entering from said compartment and to release water from said receptacle into said pail.

3. A scrubbing pail device comprising a pail having a bottom and surrounding side wall with an open upper edge portion, a watertight tank like compartment to contain a reservoir of fluid and having a bottom, surrounding side wall and top to form a watertight enclosure, said compartment having detachable mounting means to detachably mount said compartment to said pail along the top of the pail and adjacent the open upper edge portion, said compartment having a receptacle mounted to said compartment hoizontally beside the compartment, said receptacle having a bottom, surrounding side wall portion and open upper edge and mounted horizontally beside the compartment so that said receptacle's open upper edge is accessable from the top to receive a mop therein, said receptacle being detachable from said pail with said compartment, said receptacle, when attached to said pail, having its bottom above the bottom of the pail, passage means between lower portions of the compartment and portions of the receptacle with the bottom of said receptacle below the bottom of the compartment to provide a gravity flow of fluid from said compartment to the receptacle, valve means including a first valve means in said passage means between said compartment and receptacle to open and close said passage means to selectively allow fluid to flow from said compartment to said receptacle to moisten a mop therein under a gravity flow, said valve means including a second valve means to open and close openings along the bottom of said receptacle, whereby an operator may operate said second valve means to allow fluid in said receptacle after being used to moisten and clean said mop to be allowed to flow out of said openings in said bottom of said receptacle into said pail, said tank like compartment having an opening in its top whereby said compartment may be detached from said pail by said detachable mounting and carried to a fresh source of fluid and replenished via said opening with fresh fluid and reattached to said pail for further moistening and cleaning of said mop.

* * * * *